US008674907B2

(12) United States Patent
Kwon

(10) Patent No.: US 8,674,907 B2
(45) Date of Patent: Mar. 18, 2014

(54) PIXEL CIRCUITS OF FLAT PANEL DISPLAY DEVICES

(75) Inventor: Oh-Kyong Kwon, Seoul (KR)

(73) Assignee: IUCF-HYU (Industry-University Cooperation Foundation Hanyang-University), Seoul (KR)

( * ) Notice: Subject to any disclaimer, the term of this patent is extended or adjusted under 35 U.S.C. 154(b) by 186 days.

(21) Appl. No.: 13/156,273

(22) Filed: Jun. 8, 2011

(65) Prior Publication Data

US 2012/0280634 A1 Nov. 8, 2012

(30) Foreign Application Priority Data

May 2, 2011 (KR) ..... 10-2011-0041586

(51) Int. Cl.
*G09G 3/30* (2006.01)
*G09G 3/20* (2006.01)

(52) U.S. Cl.
USPC ..... 345/76; 345/55

(58) Field of Classification Search
None
See application file for complete search history.

(56) References Cited

U.S. PATENT DOCUMENTS

2005/0140600 A1* 6/2005 Kim et al. ..... 345/76
2006/0071879 A1* 4/2006 Giraldo et al. ..... 345/55
2006/0238135 A1* 10/2006 Kimura ..... 315/169.3

OTHER PUBLICATIONS

Kwak et al., *Organic Light-Emitting Diode-on-Silicon Pixel Circuit Using the Source Follower Structure with Active Load for Microdisplays*, The Japan Society of Applied Physics, reprinted from Japanese Journal of Applied Physics, 2011; 03CC05; 1-5, 6 sheets.
Kwak et al., *Organic Light-Emitting Diode-on-Silicon Pixel Circuit for Microdisplays Immune to Electrical Characteristics Variation of Organic Light-Emitting Diodes*, The Proceedings of AM-FPD 10, 2010, pp. 271-274, 5 sheets.

* cited by examiner

*Primary Examiner* — Alexander S Beck
*Assistant Examiner* — Ibrahim Khan
(74) *Attorney, Agent, or Firm* — Finnegan Henderson Farabow Garrett & Dunner LLP

(57) ABSTRACT

Disclosed is a pixel capable of finely controlling the amount of current and increasing the voltage range of a data signal. A pixel includes an organic light emitting diode, a first transistor, a storage capacitor, a load and an amplifier. The first transistor is coupled between a scan line and a data line, and supplies a data signal supplied to the data line to a first node when a scan signal is supplied to the scan line. The storage capacitor is coupled between the first node and a first power source, and charges a voltage corresponding to the data signal. The load is coupled between the organic light emitting diode and the first power source. The amplifier controls a voltage applied to the load corresponding to the voltage charged in the storage capacitor.

10 Claims, 11 Drawing Sheets

PIXEL CIRCUITS OF FLAT PANEL DISPLAY DEVICES

RELATED APPLICATIONS

This application claims priority to and the benefit of Korean Patent Application No. 10-2011-0041586, filed on May 2, 2011, in the Korean Intellectual Property Office, the entire content of which is incorporated herein by reference.

BACKGROUND

1. Field

An aspect of the present invention relates to a pixel, and more particularly, to a pixel capable of finely controlling the amount of current and increasing the voltage range of a data signal.

2. Description of the Related Art

Recently, there have been developed various types of flat panel display devices capable of reducing the weight and volume of cathode ray tubes, which are disadvantages. The flat panel display devices include a liquid crystal display, a field emission display, a plasma display panel, an organic light emitting display, and the like.

Among these flat panel display devices, the organic light emitting display displays images using organic light emitting diodes that emit light through recombination of electrons and holes. The organic light emitting display has a fast response speed and is driven with low power consumption. A conventional organic light emitting display supplies current corresponding to a data signal to an organic light emitting diode using a transistor formed in each pixel, so that light is emitted from the organic light emitting diode.

The conventional organic light emitting display includes a data driver for supplying a data signal to data lines, a scan driver for sequentially supplying a scan signal to scan lines, and a pixel unit having a plurality of pixels coupled to the scan and data lines.

When the scan signal is supplied to a scan line, pixels included in the pixel unit are selected to receive the data signal from a data line. The pixels that receive the data signal display an image while emitting light with predetermined luminance corresponding to the data signal.

Meanwhile, the data signal is supplied to have a predetermined voltage range corresponding to desired luminance. In the organic light emitting display in which the pixel controls micro-current, the data signal is necessarily set to a narrow voltage range corresponding to the micro-current. However, there is a limitation in lowering the voltage range of the data signal due to an error of a digital-to-analog converter (DAC) included in the data driver, or the like.

The conventional pixel controls the amount of current using a voltage between gate and source electrodes of the driving transistor. However, in a case where the voltage between the gate and source electrodes of the driving transistor in the conventional pixel, it is difficult to finely control the amount of current.

SUMMARY

Embodiments provide a pixel capable of finely controlling the amount of current and increasing the voltage range of a data signal.

According to the present invention, a pixel can finely control the amount of current. The pixel of the present invention can constantly supply desired current regardless of a change in voltage applied to an anode electrode of an organic light emitting diode, thereby improving the reliability of the pixel.

The pixel of the present invention can supply an output voltage having a voltage range narrower than that of a data signal to a gate electrode of a driving transistor using a bias circuit. In this case, the data signal can be set to a relatively wide voltage range, although the pixel controls micro-current.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
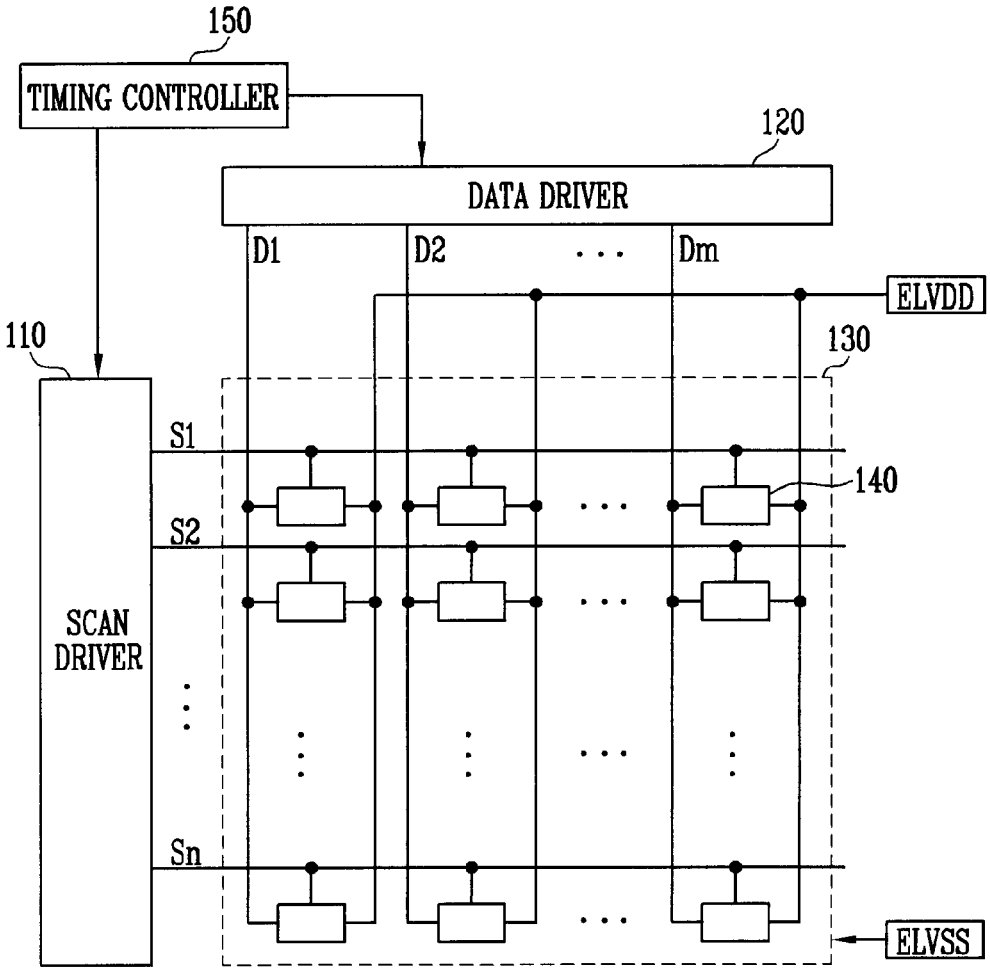
FIG. 1 is a block diagram showing an organic light emitting display according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 is a block diagram showing an organic light emitting display according to an embodiment of the present invention.

Referring to FIG. 1, the organic light emitting display according to this embodiment includes a pixel unit 130 having pixels 140 positioned at intersection portions of scan lines S1 to Sn and data lines D1 to Dm, a scan driver 110 for driving the scan lines S1 to Sn, a data driver 120 for driving the data lines D1 to Dm, and a timing controller 150 for controlling the scan driver 110 and the data driver 120.

The scan driver 110 generates a scan signal under a control of the timing controller 150 and sequentially supplies the generated scan signal to the scan lines S1 to Sn. Here, the scan signal is set to a voltage (e.g., a low polarity) at which a transistor included in the pixel 140 can be turned on.

The data driver 120 generates a data signal under a control of the timing controller 150 and supplies the generated data signal to the data lines D1 to Dm in synchronization with the scan signal.

The timing controller 150 controls the scan driver 110 and the data driver 120. The timing controller 150 realigns data supplied from the outside thereof and transfers the realigned data to the data driver 120.

The pixel unit 130 has pixels 140 positioned at intersection portions of the scan lines S1 to Sn and the data lines D1 to Dm. The pixels 140 receive a first power source ELVDD and a second power source ELVSS, supplied from the outside thereof. When a scan signal is supplied to pixels 140, the pixels 140 are selected to receive a data signal supplied from the data driver 120. Then, the pixels 140 supplies current corresponding to the received data signal from the first power source ELVDD to the second power source ELVSS via organic light emitting diodes, thereby emitting predetermined light.

Figure 2:
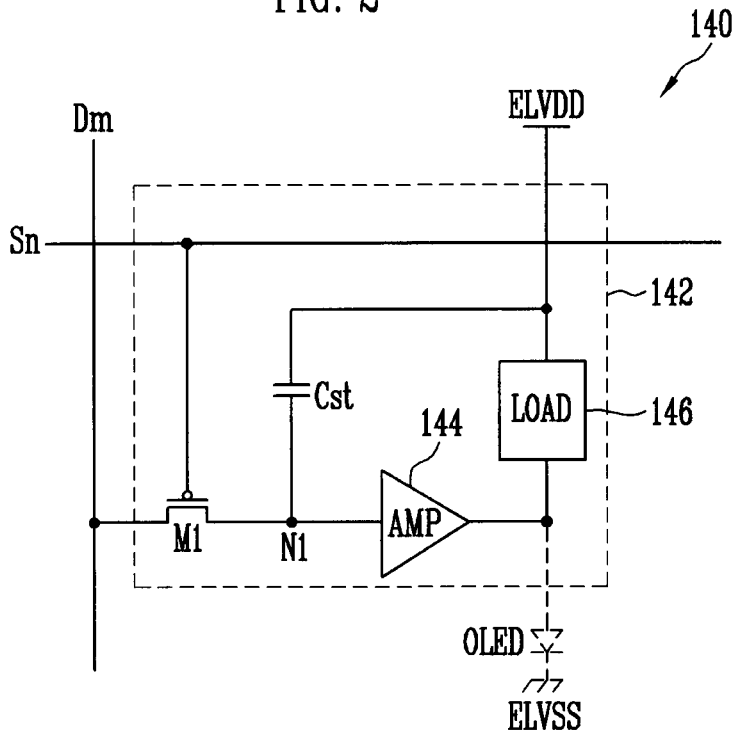
FIG. 2 is a circuit diagram schematically showing an embodiment of a pixel shown in FIG. 1.

FIG. 2 is a circuit diagram schematically showing an embodiment of a pixel shown in FIG. 1.

Referring to FIG. 2, the pixel 140 according to this embodiment includes an organic light emitting diode OLED and a pixel circuit 142 that controls the amount of current supplied to the organic light emitting diode OLED.

An anode electrode of the organic light emitting diode OLED is coupled to the pixel circuit 142, and a cathode electrode of the organic light emitting diode OLED is coupled to the second power source ELVSS. The organic light emitting diode OLED emits light with predetermined luminance corresponding to the current supplied from the pixel circuit 142.

When a scan signal is supplied to a scan line Sn, the pixel circuit 142 receives a data signal supplied from a data line Dm. The pixel circuit 142 controls the amount of current supplied to the organic light emitting diode OLED corresponding to the data signal. To this end, the pixel circuit 142 includes a first transistor M1, an amplifier 144, a load 146 and a storage capacitor Cst.

A gate electrode of the first transistor M1 is coupled to the scan line Sn, and a first electrode of the first transistor M1 is coupled to the data line Dm. A second electrode of the first transistor M1 is coupled to a first node N1. When a scan signal is supplied to the scan line Sn, the first transistor M1 is turned on to supply a data signal to the first node N1.

The storage capacitor Cst is coupled between the first node N1 and the first power source ELVDD. The storage capacitor Cst charges a voltage corresponding to the data signal.

The load 46 is coupled between the first power source ELVDD and the organic light emitting diode OLED. The load 146 controls the amount of current flowing in the organic light emitting diode OLED corresponding to a voltage supplied from the amplifier 144. The load 146 may be implemented in various shapes so as to have a predetermined resistance.

Figure 3:
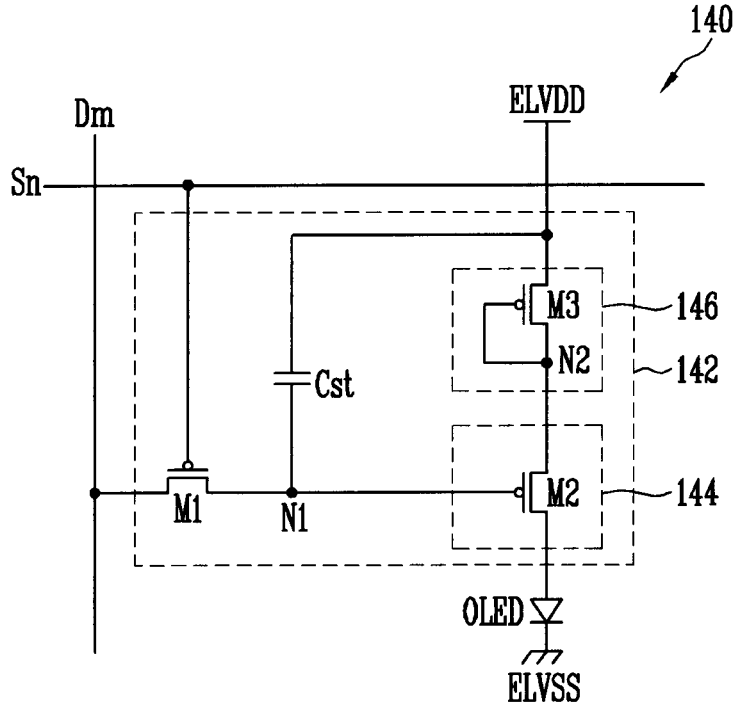
FIG. 3 is a circuit diagram specifically showing an amplifier and a load, shown in FIG. 2.

For example, the load 146 may be implemented as a third transistor M3, as shown in FIG. 3. Here, the third transistor M3 has a first electrode coupled to the first power source ELVDD, and a gate electrode and a second electrode, coupled to the amplifier 144. The third transistor M3 is diode-coupled, and controls the amount of current corresponding to a voltage applied to the gate electrode and second electrode of the third transistor M3.

One end of the amplifier 144 is coupled to the first node N1, and the other end of the amplifier 144 is coupled to the load 146 and the organic light emitting diode OLED. The amplifier 144 controls the voltage supplied to the load corresponding to a voltage stored in the storage capacitor Cst.

The amplifier 144 is implemented as a second transistor M2, as shown in FIG. 3. A first electrode of the second transistor M2 is coupled to the gate electrode and second electrode (i.e., a second node N2) of the third transistor M3, and a second electrode of the second transistor M2 is coupled to the organic light emitting diode OLED. A gate electrode of the second transistor M2 is coupled to the first node N1. The second transistor M2 controls the voltage supplied to the second node N2 according to a voltage applied to the first node N1.

Figure 4:
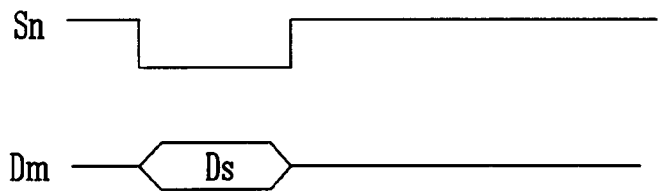
FIG. 4 is a waveform diagram illustrating a driving method of the pixel shown in FIG. 3.

FIG. 4 is a waveform diagram illustrating a driving method of the pixel according to the embodiment of the present invention.

The operating process of the pixel will be described in detail in conjunction with FIGS. 3 and 4. First, a scan signal is supplied to the scan signal Sn so that the first transistor M1 is turned on. If the first transistor M1 is turned on, a data signal DS from the data line Dm is supplied to the first node N1.

If the data signal DS is supplied to the first node N1, the storage capacitor Cst charges a voltage corresponding to the data signal DS supplied to the first node N1. Subsequently, the scan signal is supplied to the scan line Sn, so that the first transistor M1 is turned on. In this instance, the storage capacitor Cst supplies the voltage of the data signal DS charged when the scan signal is supplied while maintaining the voltage of data signal DS during one frame period.

The second transistor M2 controls the voltage at the second node N2 corresponding to the voltage applied to the first node N1. In this instance, the amount of current supplied to the organic light emitting diode OLED corresponding to a voltage applied to the second node N2.

Figure 5:
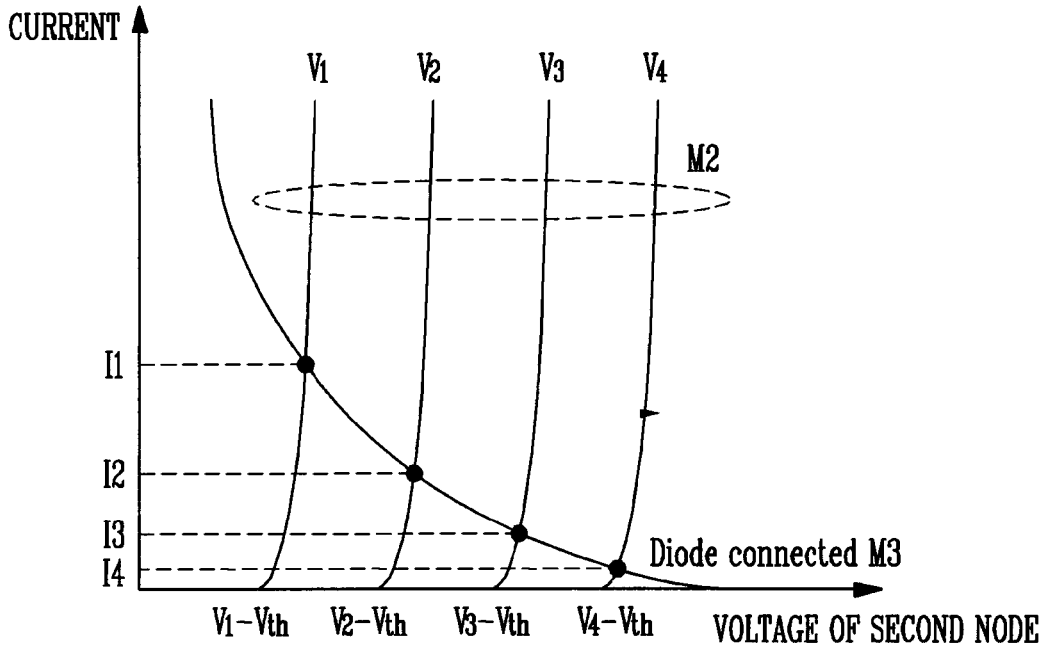
FIG. 5 is a graph illustrating a principle that the amount of current is controlled corresponding to voltage in the pixel shown in FIG. 3.

FIG. 5 is a graph illustrating a principle that the amount of current is controlled corresponding to a voltage at the second node.

Referring to FIG. 5, when a data voltage is applied to the first node N1, the second transistor M2 operates as a source follower. Thus, the voltage of the first electrode of the second transistor M2 (i.e., the voltage at the second node N2) is changed depending on a voltage at the first node N1.

Practically, when a data signal having a first voltage V1 is supplied, the voltage at the second node N2 is ideally set to a voltage (V1-Vth) obtained by subtracting the threshold voltage Vth of the second transistor M2 from the first voltage V1. Similarly, when the voltage of the data signal is converted into a second voltage V2, a third voltage V3 and a fourth voltage V4, the voltage at the second node N2 is set to voltages of V2-Vth, V3-Vth and V4-Vth.

In this case, the amount of current I1, I2, I3 or I4 supplied to the organic light emitting diode OLED is controlled by the characteristic curve of the diode-coupled third transistor M3 and the voltage applied to the second node N2.

Figure 6:
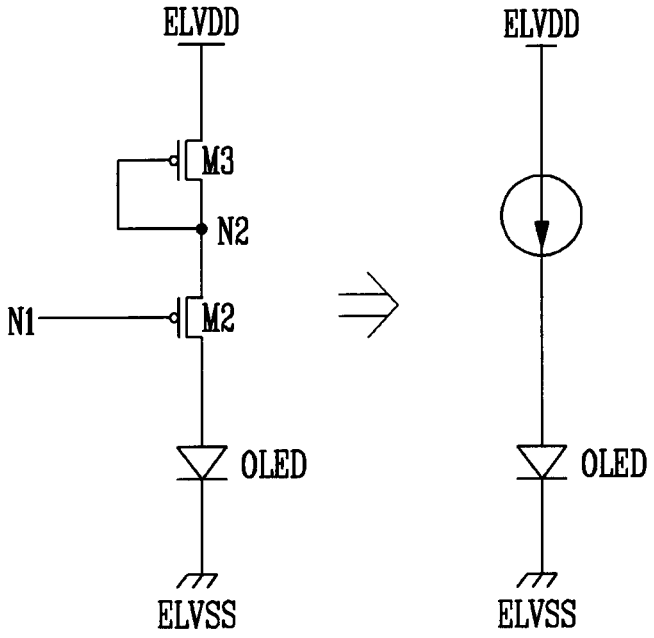
FIG. 6 is a circuit diagram equivalently showing a current source in the pixel shown in FIG. 3.

That is, in this embodiment, the voltage at second node N2 is changed corresponding to the voltage of the data signal applied to the first node N1, and accordingly, the amount of current flowing in the organic light emitting diode OLED can be controlled. Practically, as shown in FIG. 6, the second and third transistors M2 and M3 are driven as a current source.

Meanwhile, in this embodiment, the amount of current I1, I2, I3 or I4 is determined regardless of the voltage applied to the anode electrode of the organic light emitting diode OLED.

In this case, the current source can be more stably implemented in the pixel 140, thereby improving the reliability of the pixel 140.

Figure 7A:
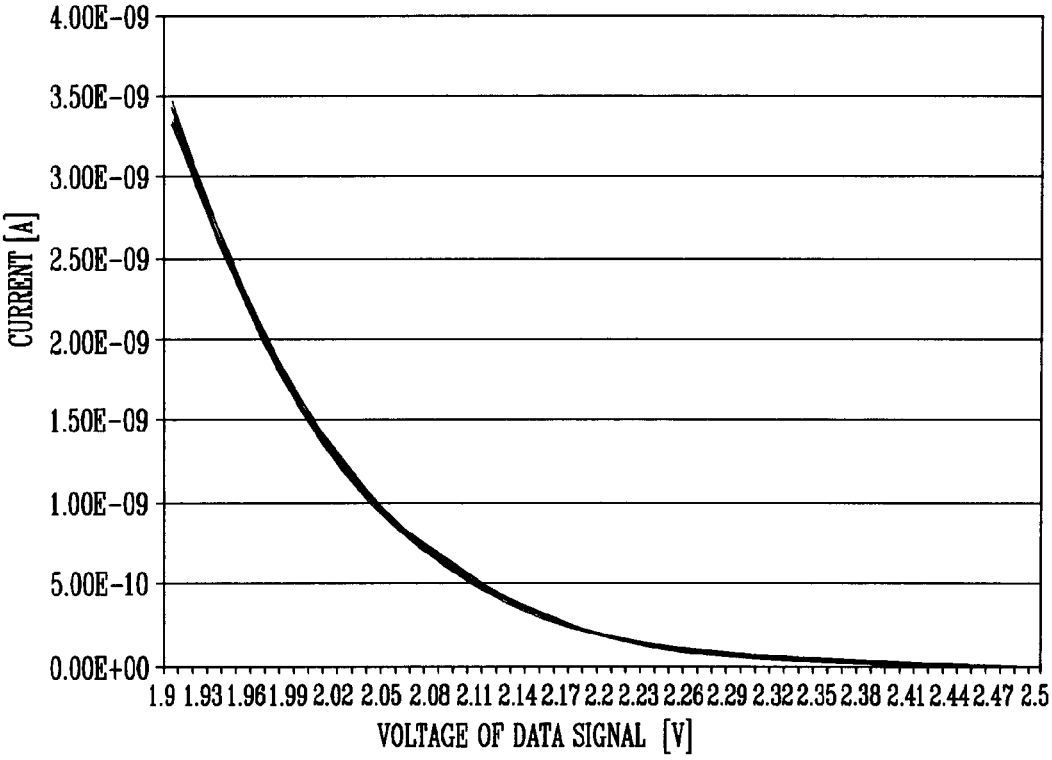
FIGS. 7A and 7B are simulation results showing changes in amount of current corresponding to voltage in the pixel according to the present invention and the conventional pixel.
Figure 7B:
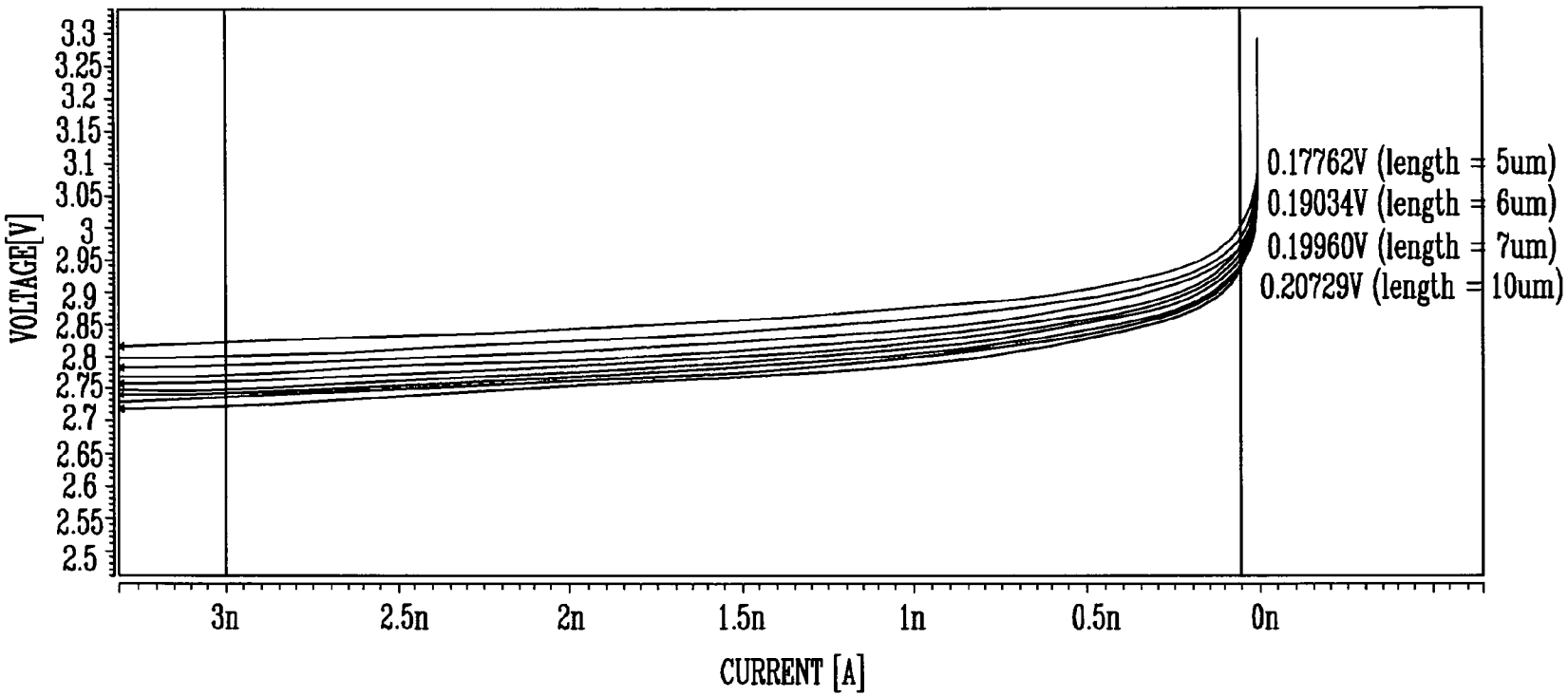

FIGS. 7A and 7B are graphs showing changes in amount of current corresponding to voltage. FIG. 7A is a graph obtained by measuring a change in amount of current using a driving transistor (i.e., the second transistor M2) having a channel length of 7 μm in the pixel shown in FIG. 3 according to the present invention. FIG. 7B is a graph obtained by measuring a change in amount of current while changing the channel length of a driving transistor into 5, 6, 7 and 10 μm in a conventional pixel (a pixel including two transistors and one capacitor).

Referring to FIG. 7A, the current flowing in the organic light emitting diode OLED is changed into approximately 3.5 nA while the voltage of a data signal is changed from 1.9V to 2.5V. That is, in the present invention, the current of 3.5 nA is changed corresponding to a change in voltage of 600 mV.

However, in the conventional pixel, a voltage of 177 mA is changed so that a current of 3 nA is changed when the channel length is set to 5 μm as shown in FIG. 7B. When the channel length is set to 6 μm, a voltage of 190 mV is changed so that the current of 3 nA is changed. When the channel length is set to 7 μm, a voltage of 199 mV is changed so that the current of 3 nA is changed.

That is, in the conventional pixel, a voltage of approximately 200 mV is changed corresponding to a change in voltage of 3 nA in the conventional pixel, and hence it is difficult to finely control the amount of current. However, in the present invention, a voltage of approximately 600 mV is changed corresponding to a change in current of 3.5 nA, and hence the amount of current can be finely controlled while changing voltage.

Figure 8:
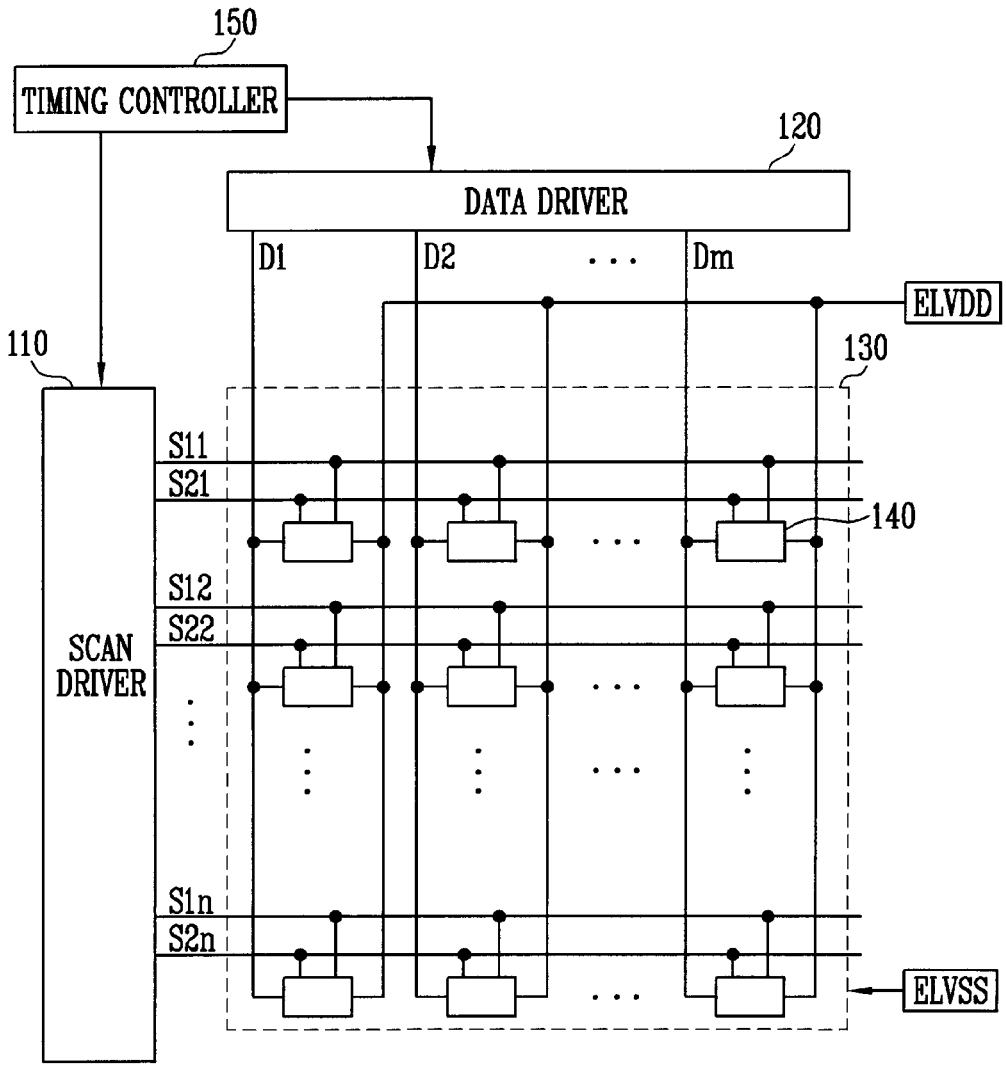
FIG. 8 is a block diagram showing an organic light emitting display according to another embodiment of the present invention.

FIG. 8 is a block diagram showing an organic light emitting display according to another embodiment of the present invention. When describing FIG. 8, components identical to those of FIG. 1 are designated by the same reference numerals, and their detailed descriptions will be omitted.

Referring to FIG. 8, the organic light emitting display according to this embodiment includes a pixel unit 130 having pixels 140' positioned at intersection portions of first scan lines S11 to S1*n*, second scan lines S21 to S2*n* and data lines D1 to Dm, a scan driver 110' for driving the first scan lines S11 to S1*n* and the second scan lines S21 to S2*n*, a data driver 120' for driving the data lines D1 to Dm, and a timing controller 150 for controlling the scan driver 110' and the data driver 120'.

The scan driver 110' sequentially supplies a first scan signal to the first scan lines S11 to S1*n* and sequentially supplies a second scan signal to the second scan lines S21 to S2*n* under a control of the timing controller 150. The first scan signal is set to have a width narrower than that of the second scan signal. The first scan signal supplied to an i-th ('i' is a natural number) first scan line S1*i* is supplied to overlap with the second scan signal supplied to an i-th second scan line S2*i*. Meanwhile, the first and second scan signals are set to a voltage (e.g., a low voltage) at which the transistor included in the pixel can be turned on.

The data driver 120' generates a data signal under a control of the timing controller 150, and supplies the generated data signal to the data lines D1 to Dm in synchronization with the second scan signal.

The pixel unit 130 has pixels 140' positioned at intersection portions of the first scan lines S11 to S1*n* and the data lines D1 to Dm. The pixels 140' receives a first power source ELVDD and a second power source ELVSS set to a voltage lower than that of the first power source ELVDD from the outside of the pixel unit 130.

When the first and second scan signals are supplied to pixels 140', the pixels 140' are selected to receive a data signal supplied from the data driver 120'. Here, a voltage having a voltage range lower than that of the data signal is applied to a gate electrode of a driving transistor included in each of the pixels 140'. Accordingly, the voltage range of the data signal can be widely set even when micro-current is controlled in the pixels 140'.

More specifically, in a case where a data signal is directly supplied to the gate electrode of the driving transistor, the data signal is necessarily controlled to have a low voltage range so as to control the micro-current. However, if a voltage having a voltage range lower than that of the data signal is applied to the gate electrode of the driving transistor in this embodiment, micro-current can be controlled, although the voltage range of the data signal is widely set.

Figure 9:
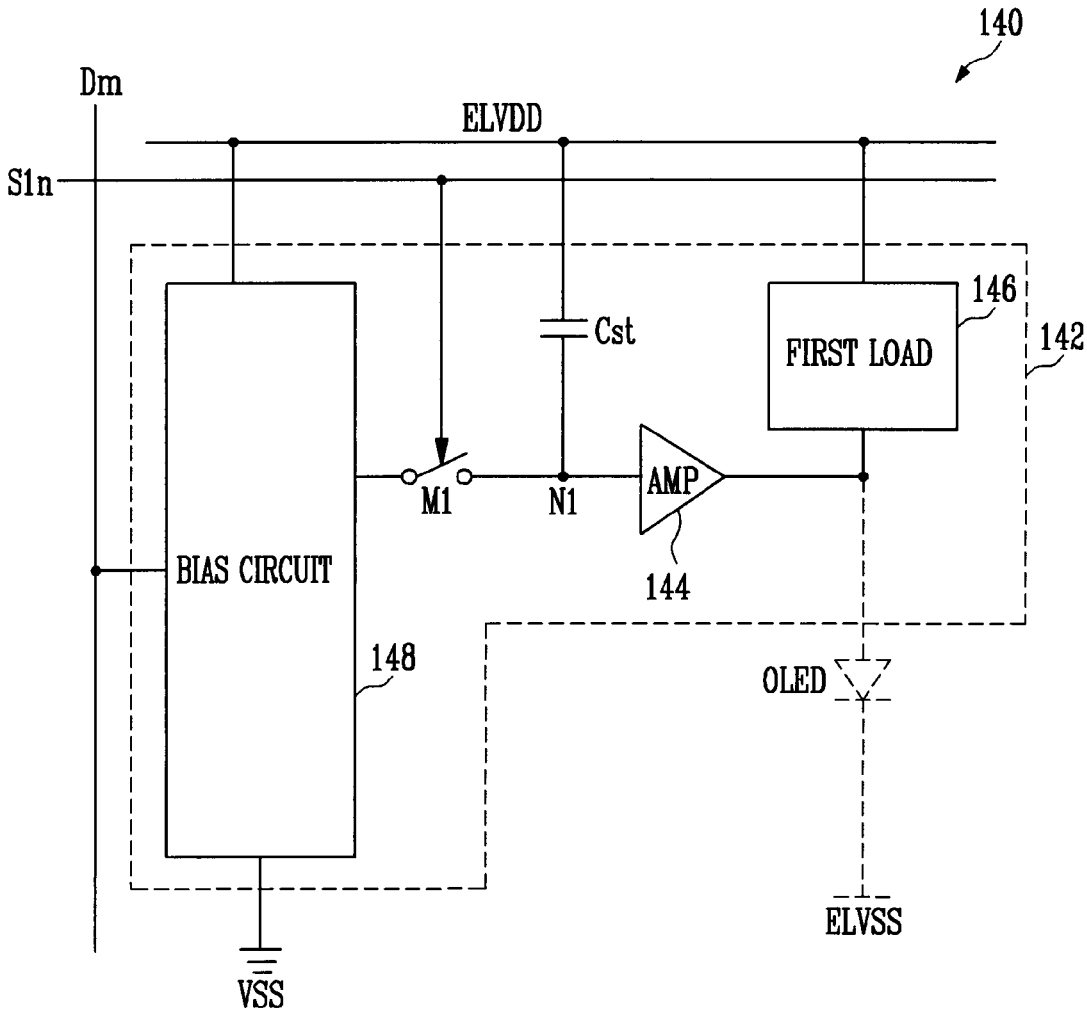
FIG. 9 is a circuit diagram schematically showing an embodiment of a pixel shown in FIG. 8.

FIG. 9 is a circuit diagram schematically showing an embodiment of a pixel shown in FIG. 8. For convenience of illustration, a pixel coupled to an n-th first scan line S1*n* and an m-th data line Dm is shown in FIG. 9. When describing FIG. 9, components identical to those of FIG. 2 are designated by the same reference numerals, and their detailed descriptions will be omitted.

Referring to FIG. 9, the pixel 140' according to this embodiment includes an organic light emitting diode OLED and a pixel circuit 142' for controlling the amount of current supplied to the organic light emitting diode OLED.

An anode electrode of the organic light emitting diode OLED is coupled to the pixel circuit 142', and a cathode electrode of the organic light emitting diode OLED is coupled to a second power source ELVSS. The organic light emitting diode OLED emits light with predetermined luminance corresponding to the amount of current supplied from the pixel circuit 142'.

The pixel circuit 142' receives a data signal from the data line Dm and supplies a voltage lower than that of the data signal to a first node N1. Then, an amplifier 144 controls a voltage applied to a first load 146 corresponding to the voltage at the first node N1, and accordingly, the amount of current supplied to the organic light emitting diode OLED is controlled. To this end, the pixel circuit 142' includes a first transistor M1', the amplifier 144, the first load 146 and a bias circuit 148.

The bias circuit 148 receives a data signal from the data line Dm. The bias circuit 148 that receives the data signal from the data line Dm supplies a voltage lower than that of the data signal to the first node N1.

A gate electrode of the first transistor M1' is coupled to the first scan line S1*n*, and a first electrode of the first transistor M1' is coupled to the bias circuit 148. A second electrode of the first transistor M1' is coupled to the first node N1. When a first scan signal is supplied to the first scan line S1*n*, the first transistor M1' is turned on to supply the voltage from the bias circuit 148 to the first node N1.

Figure 10:
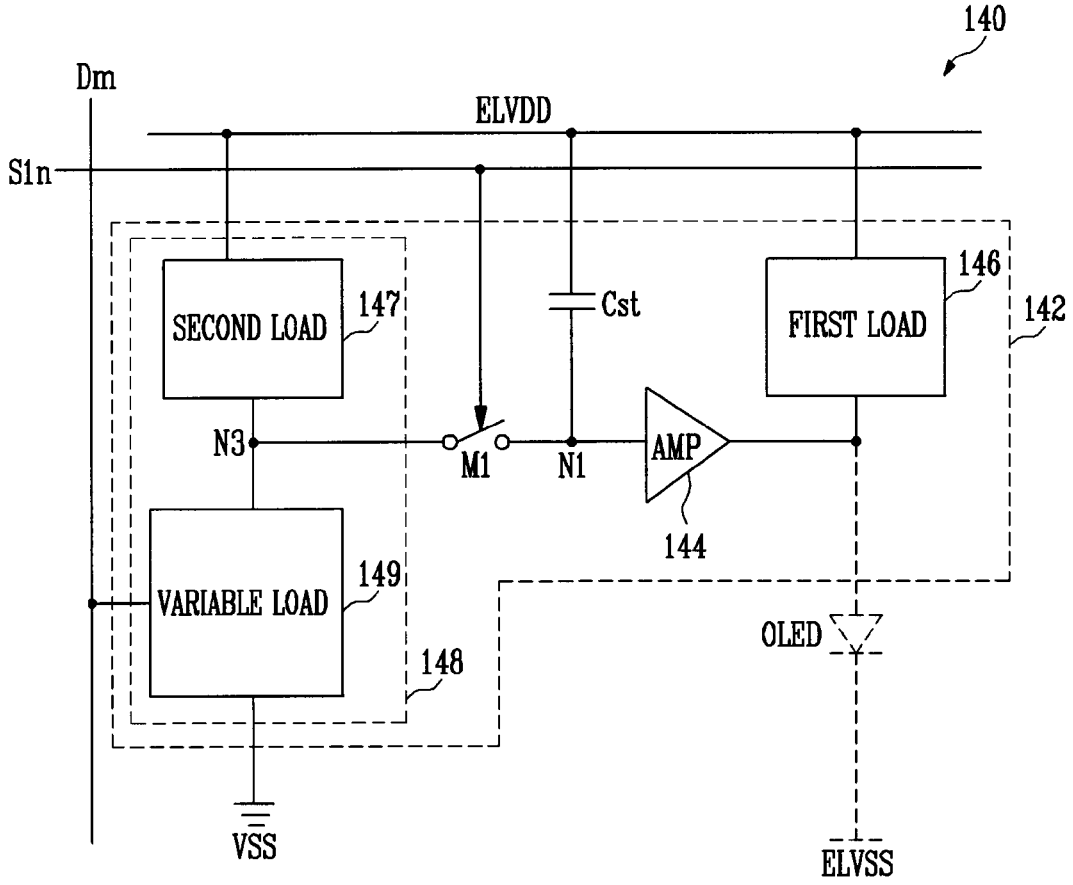
FIG. 10 is a circuit diagram schematically showing an embodiment of a bias circuit shown in FIG. 9.

FIG. 10 is a circuit diagram schematically showing an embodiment of a bias circuit shown in FIG. 9.

Referring to FIG. 10, the bias circuit 148 according to this embodiment includes a second load 147 and a variable load 149.

The second load 147 is coupled between a first power source ELVDD and a third node N3. The second load 147 is formed to have a predetermined resistance.

The variable load 149 is coupled between the third node N3 and a third power source VSS. The resistance of the variable load 149 is varied corresponding to the data signal supplied from the data line Dm. Here, the second load 147 is set to a fixed resistance, and hence the voltage applied to the third node N3 is determined by the resistance of the variable load 149.

Practically, the variable load 149 is formed using a transistor or the like, and controls the voltage lower than that of the data signal to be applied to the third node N3. In this case, as shown in FIG. 11, a voltage lower than that of the data signal directly supplied to the third node N3 is applied to the third node N3.

Figure 11:
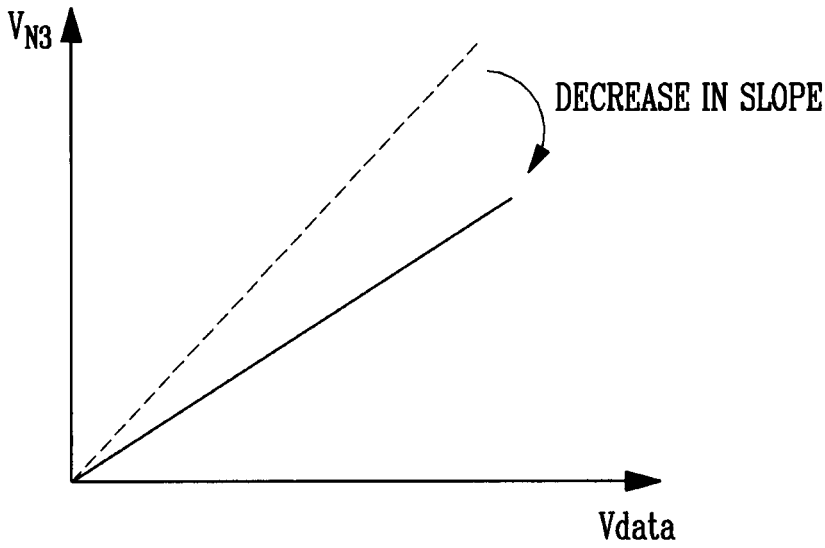
FIG. 11 is a graph showing a voltage applied to a third node corresponding to a data signal.

In FIG. 11, dotted line indicates a case where the data signal is directly supplied to the third node N3, and solid line indicates the voltage at the third node N3 when the data signal is supplied to the variable load 149. As shown in FIG. 11, the voltage applied to the third node N3 has a voltage range narrower than that of the data signal. In this case, although the pixel is applied to a display (e.g., a glass-type display, micro-type display, or projection) for controlling micro-current, the data signal may be set to have a relatively wide voltage range.

Figure 12:
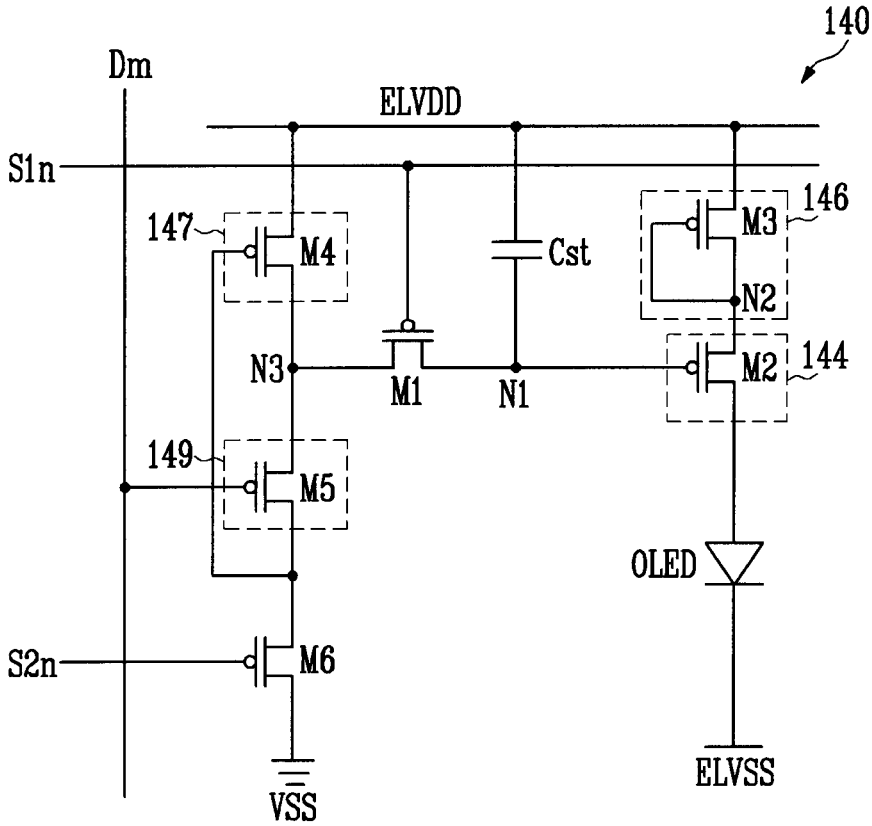
FIG. 12 is a circuit diagram showing an embodiment of a circuit for implementing a first load, a second load, an amplifier, and a variable load, shown in FIG. 10.

FIG. 12 is a circuit diagram showing an embodiment of a circuit for implementing a first load, the second load, the amplifier, and the variable load, shown in FIG. 10.

Referring to FIG. 12, the first load 146 is implemented as a diode-coupled third transistor M3. The amplifier 144 is configured as a second transistor M2 that controls the voltage at a second node N2 corresponding to the voltage at the first node N1. Since the third transistor M3 and the second transistor M2 have been previously described above, their detailed descriptions will be omitted.

The first transistor M1' is coupled between the third node N3 and the first node N1. When a first scan signal is supplied to the first scan line S1*n*, the first transistor M1' is turned on to supply the voltage at the third node N3 to the first node N1.

The second load 147 is implemented as a fourth transistor M4. Here, a first electrode of the fourth transistor M4 is coupled to the first power source ELVDD, and a gate electrode of the fourth transistor M4 is coupled to a first electrode of a sixth transistor M6. A second electrode of the fourth transistor M4 is coupled to the third node N3. The fourth transistor M4 is diode-coupled, and is formed to have a predetermined resistance.

The variable load 149 is implemented as a fifth transistor M5. Here, a first electrode of the fifth transistor M5 is coupled to the third node N3, and a gate electrode of the fifth transistor M5 is coupled to the data line Dm. A second electrode of the fifth transistor M5 is coupled to the first electrode of the sixth transistor M6. The fifth transistor M5 controls the voltage at the third node while changing resistance corresponding to the data signal supplied to the data line. Practically, the voltage at the third node N3 is determined corresponding to a resistance ratio of the fourth and fifth transistors M4 and M5. Here, the fourth transistor M4 is formed to have a resistance lower than that of the fifth transistor M5 so that a voltage as high as possible can be applied to the third node N3.

The first electrode of the sixth transistor M6 is coupled to the second electrode of the fifth transistor M5, and a gate electrode of the sixth transistor M6 is coupled to a second scan line S2*n*. A second electrode of the sixth transistor M6 is coupled to the third power source VSS. When a second scan signal is supplied to the second scan line S2*n*, the sixth transistor M6 is turned on to allow the fifth transistor M5 and the third power source VSS to be electrically coupled to each other.

Practically, the sixth transistor M6 is set to a turned-off state during a period except the period in which the second scan signal is supplied to the second scan line S2*n*, and accordingly, it is possible to prevent unnecessary current from being flown from the third node N3 to the third power source VSS. The sixth transistor M6 may be modified according to a designer's requirement.

Meanwhile, the third power source VSS is set to a voltage lower than that of the first power source ELVDD. For example, the third power source VSS may be a ground potential.

Figure 13:
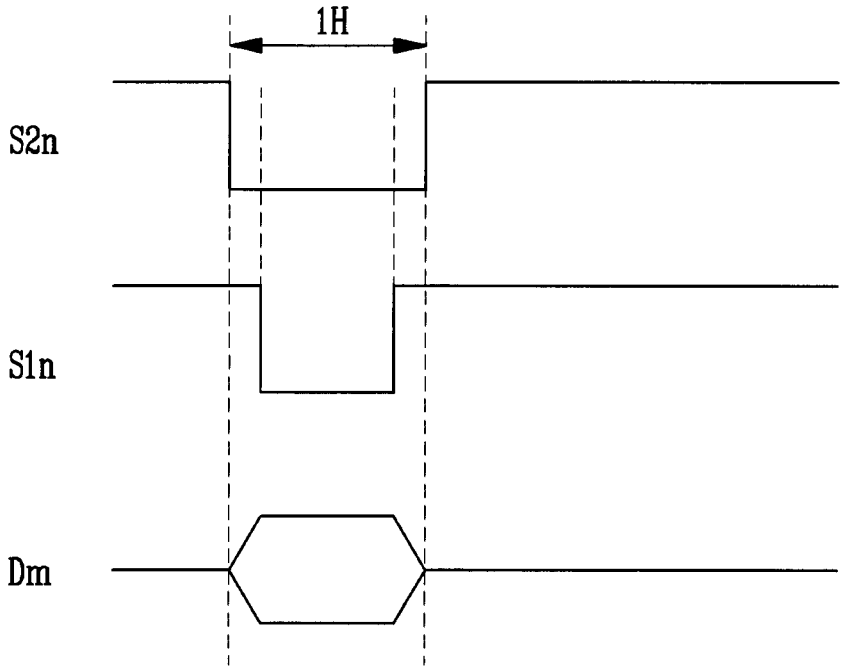
FIG. 13 is a waveform diagram illustrating a driving method of the pixel shown in FIG. 12.

FIG. 13 is a waveform diagram illustrating a driving method of the pixel shown in FIG. 12.

Referring to FIG. 13, a second scan signal is first supplied to the second scan line S2*n*, and a data signal is supplied to the data line Dm.

If the second scan signal is supplied to the second scan line S2*n*, the sixth transistor M6 is turned on. If the sixth transistor M6 is turned on, the second electrode of the sixth transistor M6 is electrically coupled to the third power source VSS.

If the data signal is supplied to the data line Dm, the fifth transistor M5 is turned on. In this instance, the voltage at the third node N3 is determined corresponding to the resistance of the fifth transistor M5 determined by the voltage of the data signal.

Subsequently, the first scan signal is supplied to the first scan line S1*n* so that the first transistor M1' is turned on. If the first transistor M1' is turned on, the voltage at the third node N3 is supplied to the first node N1. In this instance, a storage capacitor Cst charges the voltage applied to the first node N1.

After a predetermined voltage is charged in the storage capacitor Cst, the supply of the first scan signal to the first scan line S1*n* is stopped so that the first transistor M1 is turned on. After the first transistor M1 is turned off, the supply of the second scan signal to the second scan line S2*n* is stopped so that the sixth transistor M6 is turned off.

Meanwhile, the voltage at the second node N2 is approximately increased to the voltage at the first node N1 under the operation of a source follower of the second transistor M2. In this case, a predetermined current is supplied to the organic light emitting diode OLED corresponding to the characteristic curve of the diode-coupled third transistor M3 and the voltage applied to the second node N2.

That is, in this embodiment, the bias circuit 148 outputs the voltage at the third node N3 and controls the voltage at the third node N3 corresponding to the voltage of the data signal using the variable load 149. The amplifier 144 and the first load 146 control the amount of current supplied to the organic light emitting diode OLED corresponding to the difference in voltage between the first power source ELVDD fixed as a current source and the variable third node N3 (or first node N1).

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode;

a storage capacitor coupled between a first node and a first power source;

a first load coupled between the organic light emitting diode and the first power source;

an amplifier that controls a voltage applied to the first load corresponding to the voltage applied to the first node;

a bias circuit that controls the voltage applied to the first node corresponding to a data signal supplied from a data line; and a first transistor coupled between the bias circuit and the first node, the first transistor being turned on when a first scan signal is supplied to a first scan line, wherein the voltage applied to the first node is set to have a voltage range narrower than that of the data signal by the bias circuit; and wherein the bias circuit comprises:

a second load coupled between the first power source and a third node; and a variable load coupled between the third node and a second power source lower than the first power source, the variable load having resistance changed corresponding to the data signal.

2. The pixel according to claim 1, wherein the amplifier is a second transistor having a gate electrode coupled to the first node, a first electrode coupled to the first load and a second electrode coupled to the organic light emitting diode.

3. The pixel according to claim 2, wherein the first load is a third transistor having gate and second electrodes coupled to the first electrode of the second transistor and a first electrode coupled to the first power source.

4. The pixel according to claim 1, further comprising a sixth transistor having a first electrode coupled to the variable load and a second electrode coupled to the third power source, the sixth transistor being turned on when a second scan signal is supplied to a second scan line.

5. The pixel according to claim 4, wherein the sixth transistor is turned on before the first transistor is turned on, and the sixth transistor is turned off after the first transistor is turned off.

6. The pixel according to claim 4, wherein the second load is a fourth transistor having a first electrode coupled to the first power source, a second electrode coupled to the third node and a gate electrode coupled to the first electrode of the sixth transistor.

7. The pixel according to claim 6, wherein the variable load is a fifth transistor having a first electrode coupled to the third node, a second electrode coupled to the first electrode of the sixth transistor and a gate electrode coupled to the data line.

8. The pixel according to claim 7, wherein the fourth transistor is formed to have a resistance lower than that of the fifth transistor.

9. The pixel according to claim 1, wherein the first transistor is coupled between the third node and the first node.

10. A pixel comprising:

an organic light emitting diode;

a current source that generates current varied depending on a difference between a predetermined first voltage and a variable second voltage and supplies the generated current to the organic light emitting diode; and a bias circuit that outputs the variable second voltage depending on an input data voltage and controls a variable amplitude of the variable second voltage with respect to the amplitude of the input data voltage using a variable load, wherein the bias circuit comprises:

a predetermined load coupled between a power source and a first node; and the variable load coupled between the first node and a second power source lower than the first power source, the variable load having resistance changed corresponding to the input data voltage.

* * * * *